US010390140B2

(12) United States Patent
Seo et al.

(10) Patent No.: US 10,390,140 B2
(45) Date of Patent: Aug. 20, 2019

(54) OUTPUT DEVICE OUTPUTTING AUDIO SIGNAL AND CONTROL METHOD THEREOF

(71) Applicant: SAMSUNG ELECTRONICS CO., LTD., Suwon-si, Gyeonggi-do (KR)

(72) Inventors: Yun Hwa Seo, Suwon-si (KR); Na Rin Kim, Seoul (KR); Byung Jun Lee, Uiwang-si (KR); Jeong Gwan Kang, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/722,135

(22) Filed: Oct. 2, 2017

(65) Prior Publication Data

US 2018/0103321 A1 Apr. 12, 2018

(30) Foreign Application Priority Data

Oct. 10, 2016 (KR) ..... 10-2016-0130504

(51) Int. Cl.
*H04R 1/00* (2006.01)
*H04R 5/04* (2006.01)
(Continued)

(52) U.S. Cl.
CPC ..... *H04R 5/04* (2013.01); *H04R 1/1025* (2013.01); *H04R 1/1041* (2013.01);
(Continued)

(58) Field of Classification Search
CPC ..... H04R 5/04; H04R 1/1025; H04R 1/1041; H04R 1/1091; H04R 5/033;
(Continued)

(56) References Cited

U.S. PATENT DOCUMENTS 8,024,596 B2 9/2011 Burge et al.
8,655,004 B2 2/2014 Prest et al.
(Continued)

FOREIGN PATENT DOCUMENTS

JP 2004-120313 4/2004
JP 2010-529754 8/2010
WO 2009-134566 11/2009

OTHER PUBLICATIONS

Search Report and Written Opinion dated Jan. 22, 2018 in counterpart International patent application PCT/KR2017/010892.
(Continued)

*Primary Examiner* — Paul Kim
*Assistant Examiner* — Ubachukwu A Odunukwe
(74) *Attorney, Agent, or Firm* — Nixon & Vanderhye P.C.

(57) ABSTRACT

Disclosed is an output device that outputs an audio signal. An output device which outputs an audio signal includes a battery, a sensing module including a plurality of sensors, a communication circuit configured to communicate with at least one of an external electronic device and another output device coupled to the output device, and a processor electrically connected with the battery, the sensing module, and the communication circuit. The processor is configured to obtain information about a level of the battery, to obtain information about a level of another battery included in the another output device using the communication circuit, and to assign a task associated with one of the plurality of sensors to the output device and/or the another output device based on the information about the level of the battery and the information about the level of the another battery.

19 Claims, 8 Drawing Sheets

(51) Int. Cl.
*H04R 1/10* (2006.01)
*H04R 5/033* (2006.01)

(52) U.S. Cl.
CPC ..... *H04R 1/1091* (2013.01); *H04R 5/033* (2013.01); *H04R 2420/07* (2013.01); *H04R 2460/03* (2013.01)

(58) Field of Classification Search
CPC ..... H04R 2420/07; H04R 2460/03; H04R 1/105; H04M 1/05; H04W 52/0206; H04W 4/70
USPC ..... 381/74, 79, 309; 455/11.1
See application file for complete search history.

(56) References Cited

U.S. PATENT DOCUMENTS

| | | | | |
|---|---|---|---|---|
| 9,402,124 | B2 | 7/2016 | Zhang | |
| 9,497,534 | B2 | 11/2016 | Prest et al. | |
| 2008/0298606 | A1 | 12/2008 | Johnson et al. | |
| 2009/0097689 | A1 | 4/2009 | Prest et al. | |
| 2009/0271639 | A1 | 10/2009 | Burge et al. | |
| 2011/0286615 | A1 | 11/2011 | Olodort et al. | |
| 2013/0316642 | A1* | 11/2013 | Newham | H04W 52/0206 455/11.1 |
| 2014/0161300 | A1 | 6/2014 | Prest et al. | |
| 2014/0314247 | A1 | 10/2014 | Zhang | |
| 2015/0181326 | A1 | 6/2015 | Prest et al. | |
| 2015/0201284 | A1 | 7/2015 | Park et al. | |
| 2016/0157026 | A1 | 6/2016 | Guindi et al. | |
| 2016/0183009 | A1 | 6/2016 | Kim et al. | |
| 2016/0360350 | A1* | 12/2016 | Watson | H04W 4/70 |
| 2017/0010858 | A1 | 1/2017 | Prest et al. | |
| 2017/0078780 | A1* | 3/2017 | Qian | H04R 1/105 |
| 2017/0208393 | A1* | 7/2017 | Boesen | H04M 1/05 |

OTHER PUBLICATIONS

Supplemental European Search Report dated Jul. 1, 2019 for EP Application No. 17860625.7.

* cited by examiner

OUTPUT DEVICE OUTPUTTING AUDIO SIGNAL AND CONTROL METHOD THEREOF

CROSS-REFERENCE TO RELATED APPLICATION

This application is based on and claims priority under 35 U.S.C. § 119 to a Korean patent application filed on Oct. 10, 2016 in the Korean Intellectual Property Office and assigned Serial number 10-2016-0130504, the disclosure of which is incorporated by reference herein in its entirety.

TECHNICAL FIELD

The present disclosure relates generally to an audio output device and a control method of the audio output device.

BACKGROUND

With development of electronic communication industry, a portable electronic device is essential in modern life and becomes an important means of delivering information. In recent years, the electronic device has been developed in various forms worn on a body of a user to improve portability and accessibility of the user. For example, the electronic device may be a wireless audio output device (e.g., a wireless earphone or a wireless headphone) that is worn on an ear of the user or contacts the ear of the user. For example, the wireless audio output device may include a pair of output devices, which are respectively inserted into both ears of the user and which are coupled to each other wirelessly.

Each of the pair of output devices may include a battery. Even though the wireless audio output devices are used after the batteries of the wireless audio output devices are fully charged, each of battery levels of the pair of the output devices may be different. Accordingly, a battery of one of the pair of output devices may be discharged first, and then usability of the wireless audio output device may be reduced.

SUMMARY

Example of the present disclosure address at least the above-mentioned problems and/or disadvantages and to provide at least the advantages described below. Accordingly, an example aspect of the present disclosure is to provide a device and a method for consuming a battery included in each of a pair of wireless audio output devices in balance.

In accordance with an example aspect of the present disclosure, an output device that outputs an audio signal includes a battery, a sensing module including a plurality of sensors, a communication circuit configured to communicate with at least one of an external electronic device and another output device coupled to the output device, and a processor electrically connected with the battery, the sensing module, and the communication circuit. The processor is configured to obtain information about a level of the battery, to obtain information about a level of another battery included in the another output device using the communication circuit, and to assign a task associated with one of the plurality of sensors to the output device or the another output device based on the information about the level of the battery and the information about the level of the another battery.

In accordance with another example aspect of the present disclosure, an output device that outputs an audio signal includes a battery, a sensing module including a plurality of sensors, a communication circuit configured to communicate with at least one of an external electronic device or another output device coupled to the output device, and a processor electrically connected with the battery, the sensing module, and the communication circuit. The processor is configured to obtain information about a wearing state of the output device based on data sensed by the sensing module, to obtain information about a wearing state of the another output device from the another output device using the communication circuit, and to assign a task performed by at least one of the output device and the another output device to the output device or the another output device based on the information about the wearing state of the output device and the information about the wearing state of the another output device.

In accordance with another example aspect of the present disclosure, a control method of an output device that outputs an audio signal includes obtaining information about a level of a battery included in the output device, obtaining information about a level of another battery included in another output device coupled to the output device, and assigning a task associated with one of a plurality of sensors included in the output device to the output device or the another output device based on the information about the level of the battery and the information about the level of the another battery.

Other aspects, advantages, and salient features of the disclosure will become apparent to those skilled in the art from the following detailed description, which, taken in conjunction with the annexed drawings, discloses various example embodiments of the present disclosure.

According to various example embodiments of the present disclosure, each of the batteries may be consumed in balance by assigning a task based on levels of batteries included in a pair of output devices.

In addition, even though one of a pair of output devices is released from the body of the user, a user may seamless employ the other output device by assigning a task based on a wearing state of each of a pair of output devices.

Additionally, a variety of effects directly or indirectly understood through this disclosure may be provided.

BRIEF DESCRIPTION OF THE DRAWINGS

The above and/or other aspects, features, and attendant advantages of the present disclosure will be more apparent and readily appreciated from the following detailed description, taken in conjunction with the accompanying drawings, in which like reference numerals refer to like elements, and wherein.

Throughout the drawings, it should be noted that like reference numbers are used to depict the same or similar elements, features, and structures.

DETAILED DESCRIPTION

Figure 1:
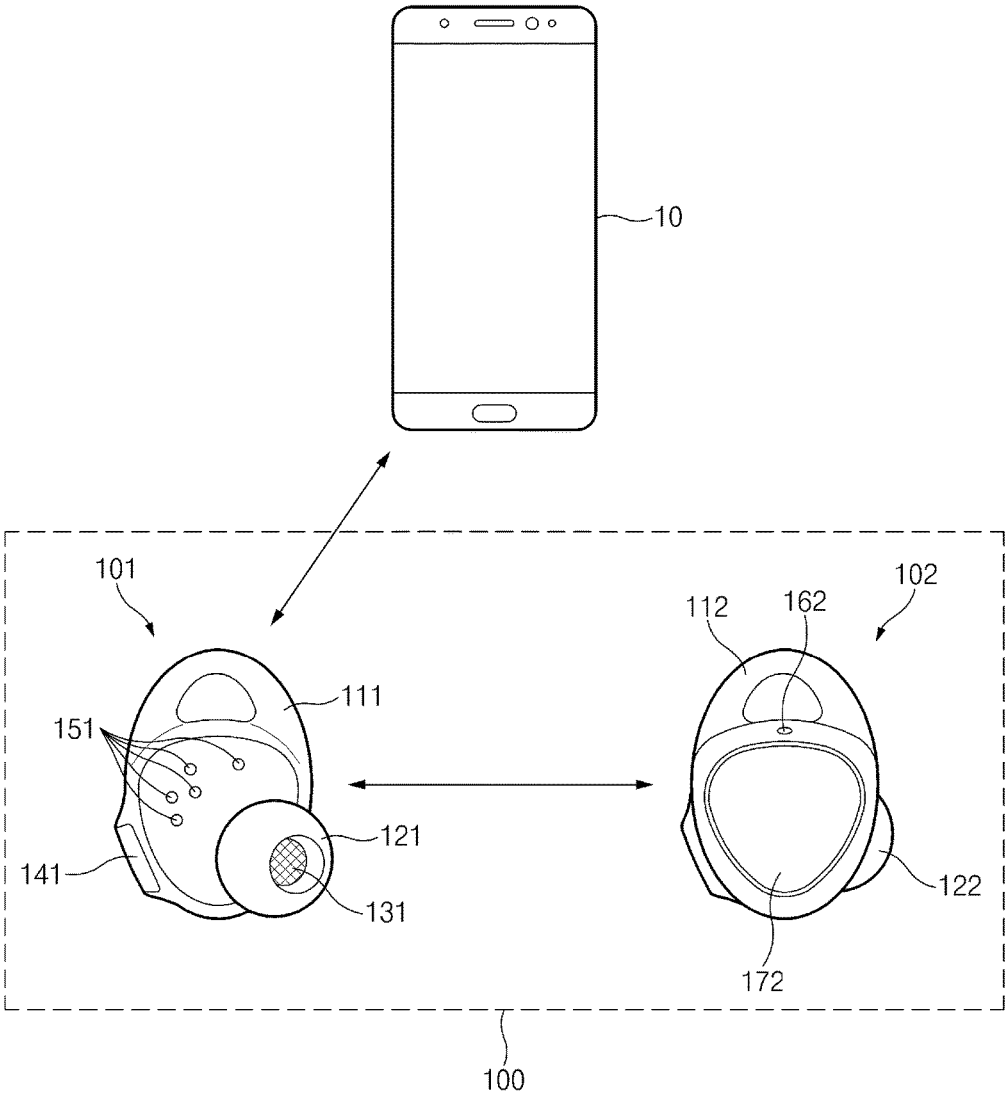
FIG. 1 is a diagram illustrating an example operating environment of an output device, according to an example embodiment.

Hereinafter, various example embodiments of the present disclosure may be described with reference to accompanying drawings. Embodiments and terms used herein are not intended to limit the technologies described in the present disclosure to specific embodiments, and it should be understood that the embodiments and the terms include modifications, equivalents, and/or alternatives of the corresponding embodiments described herein. With regard to description of drawings, similar elements may be marked by similar reference numerals. The terms of a singular form may include plural forms unless otherwise specified. In the disclosure disclosed herein, the expressions "A or B", "at least one of A or/and B", and the like used herein may include any and all combinations of one or more of the associated listed items. Expressions such as "first," or "second," and the like, may express their elements regardless of their priority or importance and may be used to distinguish one element from another element but is not limited to these components. When an (e.g., first) element is referred to as being "(operatively or communicatively) coupled with/to" or "connected to" another (e.g., second) element, it may be directly coupled with/to or connected to the other element or an intervening element (e.g., a third element) may be present.

According to the situation, the expression "configured to" used herein may be interchangeably used as, for example, the expression "suitable for", "having the capacity to", "designed to", "adapted to", "made to", or "capable of". The expression "a device configured to" may refer to a situation in which the device is "capable of" operating together with another device or other components. For example, a "processor configured to (or set to) perform A, B, and C" may refer, for example, and without limitation, to a dedicated processor (e.g., an embedded processor) for performing a corresponding operation, a generic-purpose processor (e.g., a central processing unit (CPU) or an application processor) which performs corresponding operations by executing one or more software programs which are stored in a memory device, or the like.

According to various example embodiments of the present disclosure, an electronic device may include at least one of, for example, smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, medical devices, cameras, or wearable devices, or the like, but is not limited thereto. A wearable device may include at least one of an accessory type of a device (e.g., a timepiece, a ring, a bracelet, an anklet, a necklace, glasses, a contact lens, or a head-mounted-device (HMD)), one-piece fabric or clothes type of a circuit (e.g., electronic clothes), a body-attached type of a circuit (e.g., a skin pad or a tattoo), or a bio-implantable type of a circuit, or the like, but is not limited thereto. According to an embodiment, the electronic device may include at least one of, for example, televisions (TVs), digital versatile disc (DVD) players, audios, refrigerators, air conditioners, cleaners, ovens, microwave ovens, washing machines, air cleaners, set-top boxes, home automation control panels, security control panels, media boxes (e.g., Samsung HomeSync™, Apple TV™, or Google TV™), game consoles (e.g., Xbox™ or PlayStation™), electronic dictionaries, electronic keys, camcorders, electronic picture frames, or the like, but is not limited thereto.

According to another embodiment, the electronic devices may include at least one of medical devices (e.g., various portable medical measurement devices (e.g., a blood glucose monitoring device, a heartbeat measuring device, a blood pressure measuring device, a body temperature measuring device, and the like)), a magnetic resonance angiography (MRA), a magnetic resonance imaging (MRI), a computed tomography (CT), scanners, and ultrasonic devices), navigation devices, global navigation satellite system (GNSS), event data recorders (EDRs), flight data recorders (FDRs), vehicle infotainment devices, electronic equipment for vessels (e.g., navigation systems, gyrocompasses, and the like), avionics, security devices, head units for vehicles, industrial or home robots, drones, automatic teller's machines (ATMs), points of sales (POSs), or internet of things (e.g., light bulbs, various sensors, sprinkler devices, fire alarms, thermostats, street lamps, toasters, exercise equipment, hot water tanks, heaters, boilers, and the like), or the like, but are not limited thereto. According to another embodiment, the electronic devices may include at least one of parts of furniture, buildings/structures, or vehicles, electronic boards, electronic signature receiving devices, projectors, or various measuring instruments (e.g., water meters, electricity meters, gas meters, or wave meters, and the like), or the like, but are not limited thereto. According to various embodiments, an electronic device may be a flexible electronic device or may be a combination of two or more of the above-described devices. An electronic device according to an embodiment of the present disclosure may not be limited to the above-described electronic devices. The term "user" used herein may refer to a person who uses an electronic device or may refer to a device (e.g., an artificial intelligence electronic device) that uses an electronic device.

FIG. 1 is a diagram illustrating an example operating environment of an output device, according to an example embodiment.

Referring to FIG. 1, an audio output system may include a first output device 101 and a second output device 102. For example, the audio output system may include the first output device 101 that is capable of being worn on/in one ear of a user and the second output device 102 that is capable of being worn on/in the other ear of the user. The first output device 101 may communicate with an external electronic device 10 and the second output device 102. The audio output system may operate together with the connected external electronic device 10 and may be a stand-alone device.

According to an embodiment, the external electronic device 10 may be one of various mobile devices such as, for example, and without limitation, a smartphone, a tablet PC, a smart watch, or the like. The external electronic device 10 may, for example, and without limitation, output a voice received when making a call to another electronic device, a sound source stored in the external electronic device 10, a sound source streamed in real time through a communication network, sound generated by playing of content, or the like. The above-described voice or sound source may be transmitted to the audio output system and may be output by the audio output system.

According to an embodiment, the first output device 101 may include a housing 111, an ear tip 121, a speaker 131, a heart rate (HR) sensor 141, and a terminal 151.

The housing 111 may form an appearance of the first output device 101. The ear tip 121 may be coupled to an end of the housing 111. For example, the ear tip 121 may have a cylindrical shape. The ear tip 121 may be an elastic body, and may help the first output device 101 contact the ear of the user. The speaker 131 may be disposed in the housing 111. The sound output by the speaker 131 may be transmitted to a drumhead of the user through a hollow of a tip. The HR sensor 141 may be disposed in the housing 111. When the first output device 101 is worn on the ear of the user, the HR sensor 141 may measure a heart rate of the user using at least one of an infrared ray emitting unit, a red emitting unit, a green emitting unit, or a blue emitting unit. The first output device 101 may determine whether the first output device 101 is worn on the user based, for example, on the data measured by the HR sensor 141. The terminal 151 may be electrically connected with a charging device, and a battery (not illustrated) of the first output device 101 may be charged through the terminal 151.

According to an embodiment, the first output device 101 may be wirelessly connected with the external electronic device 10. The first output device 101 may be connected with the external electronic device 10 through wireless communication (e.g., Bluetooth). The first output device 101 may be connected with the external electronic device 10 using, for example, a handsfree profile (HFP) or an advanced audio distribution profile (A2DP). In the case where the first output device 101 is connected with the external electronic device 10 using the HFP, the external electronic device 10 may be set to an HFP audio gateway (AG), and the first output device 101 may be an HFP handsfree unit (HF). In the case where the first output device 101 is connected with the external electronic device 10 using the A2DP, the external electronic device 10 may be set to an A2DP source (SRC), and the first output device 101 may be set to an A2DP sink (SNK).

According to an embodiment, the first output device 101 may be wirelessly connected with the second output device 102. The first output device 101 may be connected with the second output device 102 through, for example, wireless communication (e.g., Bluetooth). For example, the first output device 101 may be connected with the second output device 102 using the HFP or the A2DP. In this case, the first output device 101 may operate as a master, and the second output device 102 may operate as a slave. In FIG. 1, the first output device 101 is illustrated as operating a master, and the second output device 102 is illustrated as operating a slave. However, the disclosure is not limited thereto. For example, the second output device 102 may operate as the master, and the first output device 101 may operate as the slave. The first output device 101 and the second output device 102 may operate independently of the external electronic device 10.

According to an embodiment, if the first output device 101 may be worn on the ear of the user, the first output device 101 may be wirelessly connected with the second output device 102 and/or the external electronic device 10. If the first output device 101 is connected with the external electronic device 10, the first output device 101 may receive audio data associated with a voice or a sound source from the external electronic device 10. The first output device 101 may receive the audio data in the streaming manner and may output the received audio data through the speaker 131. The first output device 101 may transmit the received audio data to the second output device 102. The first output device 101 may output a sound source stored in the first output device 101 or the second output device 102. In this case, the first output device 101 may not be connected with the external electronic device 10.

According to an embodiment, the second output device 102 may include a housing 112, an ear tip 122, a microphone hole 162, and a touch pad 172. The housing 112 and the ear tip 122 of the second output device 102 may be the same configuration as the housing 111 and the ear tip 121 of the first output device 101. Although not illustrated in FIG. 1, the second output device 102 may include the same speaker, HR sensor, and terminal as the first output device 101. In addition, although not illustrated in FIG. 1, the first output device 101 may include the same microphone hole and touch pad as the second output device 102.

According to an embodiment, the microphone hole 162 may be formed in the housing 112. A microphone may be disposed under the microphone hole 162, and sound may be transmitted from the outside to a microphone through the microphone hole 162.

According to an embodiment, when the second output device 102 is inserted into the ear of the user, the touch pad 172 may be provided at a location exposed to the outside. The touch pad 172 may sense the touch of the body of the user. If a touch input is sensed by the touch pad 172, for example, the second output device 102 may execute a function such as playback, stop, fast forward, rewind, volume control, call connection, call termination, or the like, but is not limited thereto.

According to various embodiments, the first output device 101 may assign a task performed by the audio output system to the first output device 101 or the second output device 102 based on data sensed by sensors included in the first output device 101 and/or the second output device 102, information about a battery level, or a connection state of the first output device 101. The above-described operation may be performed by the second output device 102. Hereinafter, example embodiments will be described in greater detail below with reference to FIGS. 2 to 8.

Figure 2:
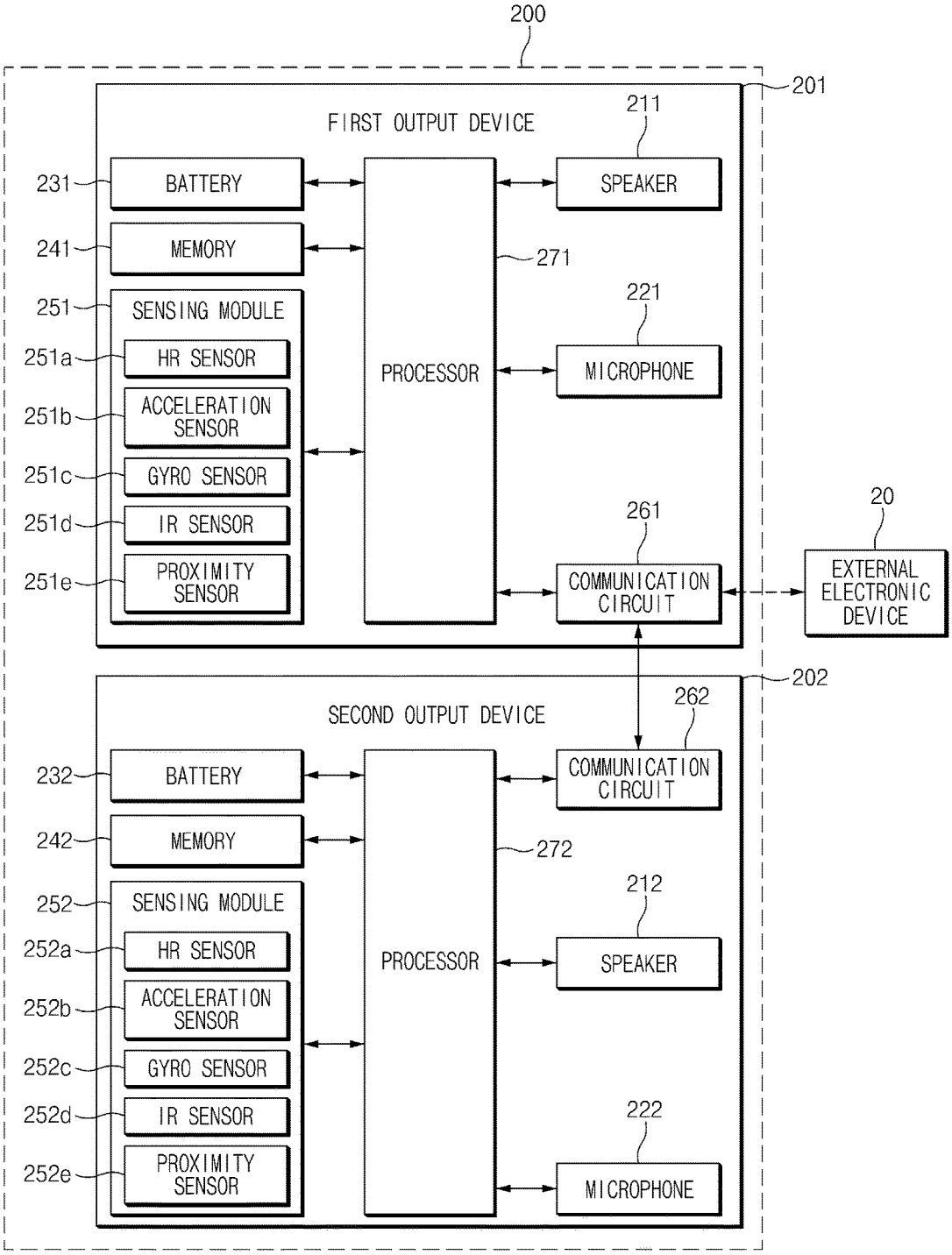
FIG. 2 is a block diagram illustrating an example configuration of an output device, according to an example embodiment.

FIG. 2 is a block diagram illustrating an example configuration of an output device, according to an example embodiment.

Referring to FIG. 2, an audio output system 200 may include a first output device 201 and a second output device 202. The first output device 201 may include a speaker 211, a microphone 221, a battery 231, a memory 241, a sensing module (e.g., including at least one sensor) 251, a communication circuit 261, and a processor (e.g., including processing circuitry) 271. The first output device 201 may, for example, be the same device as the first output device 101 illustrated in FIG. 1.

According to an embodiment, the second output device 202 may include a speaker 212, a microphone 222, a battery 232, a memory 242, a sensing module (e.g., including at least one sensor) 252, a communication circuit 262, and a processor (e.g., including processing circuitry) 272. The second output device 202 may, for example, be the same device as the second output device 102 illustrated in FIG. 1. The speaker 212, the microphone 222, the battery 232, the memory 242, the sensing module 252, the communication circuit 262, and the processor 272 of the second output device 202 may be the same configuration as the speaker 211, the microphone 221, the battery 231, the memory 241, the sensing module 251, the communication circuit 261 and the processor 271 of the first output device 201, and may execute the same function as the speaker 211, the microphone 221, the battery 231, the memory 241, the sensing module 251, the communication circuit 261 and the processor 271 of the first output device 201.

According to an embodiment, an external electronic device 20 may wirelessly communicate with the first output device 201. The external electronic device 20 may wirelessly communicate with the second output device 202. The external electronic device 20 may be the same device as the external electronic device 10 illustrated in FIG. 1.

Hereinafter, the audio output system 200 will be described based on the first output device 201.

According to an embodiment, the speaker 211 may output sound. The speaker 211 may convert audio data into sound. In the case where the first output device 201 is inserted into the ear of the user, the sound output by the speaker 211 may be transmitted to a drumhead of the user.

According to an embodiment, the microphone 221 may sense sound generated from the outside. For example, the microphone 221 may sense a voice of the user. For another example, the microphone 221 may sense the sound generated in the vicinity of the first output device 201. The sound of an ambient environment sensed by the microphone 221 may be output by the speaker 211.

According to an embodiment, the battery 231 may power other elements of the first output device 201. The battery 231 may be electrically connected with a power manager IC (PMIC) (not illustrated). In the case where the first output device 201 is connected with a charging device, the battery 231 may be charged by wire or wirelessly through the PMIC. A level of the battery 231 may be verified by the PMIC.

According to an embodiment, the memory 241 may store data associated with the first output device 201 and/or the second output device 202. For example, the memory 241 may store a sound source that is played by the first output device 201 and/or the second output device 202. For another example, the memory 241 may store data sensed by the first output device 201 and/or the second output device 202. For another example, the memory 241 may store data associated with a task performed by the first output device 201 and/or the second output device 202.

According to an embodiment, the sensing module 251 may include a plurality of sensors. For example, the sensing module 251 may include various sensors that sense a heart rate, acceleration, angular velocity, infrared ray, proximity, and/or electromyography (EMG). For example, and without limitation the sensing module 251 may include a HR sensor 251*a*, an acceleration sensor 251*b*, a gyro sensor 251*c*, an IR sensor 251*d* and a proximity sensor 251*e*. Although not illustrated in FIG. 2, the sensing module 251 may further include various types of sensors such as an EMG sensor and the like.

According to an embodiment, the communication circuit 261 may include various communication circuitry and wirelessly communicate with at least one of the external electronic device 20 or the second output device 202 coupled to the first output device 201. For example, the communication circuit 261 may search for a device that is capable of being connected in the vicinity of the first output device 201, and may try to connect the found device. The communication circuit 261 may transmit data to the connected device and may receive data from the connected device. While the connected device may update a state of the communication circuit 261, the communication circuit 261 may update a state of the connected device, and then the communication circuit 261 may transmit a command to the connected device. The communication circuit 261 may communicate with the external electronic device 20 or the second output device 202 in various manners such as, for example, and without limitation, Bluetooth, Bluetooth Low Energy (BLE), Wi-Fi Direct and/or ant plus (ANT+).

According to an embodiment, the processor 271 may include various processing circuitry and be electrically connected with the speaker 211, the microphone 221, the battery 231, the memory 241, the sensing module 251, and the communication circuit 261. The processor 271 may control the speaker 211, the microphone 221, the battery 231, the memory 241, the sensing module 251, and the communication circuit 261. The processor 271 may control the second output device 202 and/or the external electronic device 20 connected through the communication circuit 261.

According to various embodiments, the processor 271 may assign a task performed by the audio output system 200 to the first output device 201 and/or the second output device 202 based on various pieces of information.

According to an embodiment, the processor 271 may assign the task based on the level of the battery 231.

According to an embodiment, the processor 271 may obtain information about the level of the battery 231. For example, the processor 271 may obtain the information about the level of the battery 231 using the PMIC connected to the battery 231.

According to an embodiment, the processor 271 may obtain the information about the level of the battery 231 included in the second output device 202 using the communication circuit 261. For example, the processor 271 may receive the information about the level of the battery 231 from the second output device 202 using the communication circuit 261.

According to an embodiment, the processor 271 may assign a task, which is associated with one of a plurality of sensors included in the sensing module 251, to the first output device 201 or the second output device 202 based on the information about the level of the battery 231 of the first output device 201 and information about the level of the battery 232 of the second output device 202. For example, the processor 271 may assign a task, which is expected to heavily consume the battery 231, to an output device, having a higher battery level, among the first output device 201 and the second output device 202. The processor 271 may assign a task, which is expected to lightly consume the battery 231, to an output device, having battery level that is lower, among the first output device 201 and the second output device 202.

According to an embodiment, the processor 271 may assign the task to the first output device 201 or the second output device 202 based on current consumption of the task. For example, the consumed current of an acceleration sensor 251*b* may be about 0.5 mA, and the consumed current of a HR sensor may be about 2 mA. The processor 271 may assign a task associated with the acceleration sensor 251*b*, the consumed current of which is lower, to an output device, the battery level of which is lower, among the first output device 201 and the second output device 202. The processor 271 may assign a task associated with the HR sensor, the consumed current of which is greater, to an output device, the battery level of which is higher, among the first output device 201 and the second output device 202.

According to an embodiment, the processor 271 may assign the task based on a state of the sensing module 251. For example, the processor 271 may obtain information about the state of the sensing module 251 included in the first output device 201 and information about the state of the sensing module 252 included in the second output device 202. The information about the states of the sensing modules 251 and 252 may be information about whether each of a plurality of sensors included in the sensing modules 251 and 252 is available. For example, in the case where the value sensed by the sensing modules 251 and 252 is not changed, or in the case where the value sensed by the sensing modules 251 and 252 is an abnormal value, the processor 271 may determine that a sensor measuring the sensed value is in an unusable state. The processor 271 may assign the task to the first output device 201 or the second output device 202 based on the information about the state of the sensing module 251 included in the first output device 201 and the information about the state of the sensing module 252 included in the second output device 202. For example, in the case where the HR sensor 251*a* of the first output device 201 is unavailable, the processor 271 may assign a task associated with the HR sensor 251*a* to the second output device 202.

According to an embodiment, the processor 271 may assign a task based on a wearing state. For example, the processor 271 may determine whether the first output device 201 and the second output device 202 are worn on the ear of a user, and may assign a task to the first output device 201 or the second output device 202 based on the wearing state.

According to an embodiment, the processor 271 may obtain information about the wearing state of an output device based on data sensed by the sensing module 251. The processor 271 may determine whether the first output device 201 is inserted into the ear of the user, based on data sensed by the sensing module 251.

For example, if it is sensed by the proximity sensor 251*e* that an contacted object is spaced apart, the processor 271 may determine that the first output device 201 is released from the ear of the user. For another example, if acceleration (e.g., acceleration of gravity) of a specified magnitude is sensed by the acceleration sensor 251*b*, the processor 271 may determine that the first output device 201 is released from the ear of the user. For another example, if it is sensed by the proximity sensor 251*e* that an external object is contacted, the processor 271 may determine that the first output device 201 is worn on the ear of the user. For another example, if a heart rate is sensed by the HR sensor 251*a*, the processor 271 may determine that the first output device 201 is worn on the ear of the user. For another example, if acceleration or angular velocity of a specified magnitude or less is sensed by the acceleration sensor 251*b* or the gyro sensor 251*c*, if proximity of an external object is sensed by the proximity sensor 251*e*, and if a heart rate is sensed by the HR sensor 251*a*, the processor 271 may determine that the first output device 201 is worn on the ear of the user.

According to an embodiment, the processor 271 may obtain information associated with a wearing state of the second output device 202 from the second output device 202 using the communication circuit 261. For example, the processor 271 may receive data, which is sensed by the sensing module 252 of the second output device 202, from the second output device 202 and may determine the wearing state of the second output device 202 based on the received information. As another example, if the second output device 202 determines the wearing state of the second output device 202 based on the data sensed by the sensing module 252 of the second output device 202, the processor 271 may receive the determination result from the second output device 202.

According to an embodiment, the processor 271 may assign a task to the first output device 201 or the second output device 202 based on information about the wearing state of the first output device 201 and information about the wearing state of the second output device 202. For example, the processor 271 may assign a task to an output device, which is inserted into the ear of the user, of the first output device 201 and the second output device 202.

According to an embodiment, if the task is assigned to the first output device 201, the processor 271 may perform the assigned task. The processor 271 may store data associated with the performed task in the memory 241. The processor 271 may transmit data associated with the performed task by using the communication circuit 261 to the second output device 202.

According to an embodiment, the processor 271 may assign a task, which is being performed by the first output device 201, to the second output device 202. In the case where the task being performed by the first output device 201 is assigned to the second output device 202, the processor 271 may transmit data associated with the task, which is being performed by the first output device 201, to the second output device 202 using the communication circuit 261. According to an embodiment, in the case where the task being performed by the first output device 201 is assigned to the second output device 202, the processor 271 may interrupt the task being performed by the first output device 201. Even though a task being performed by one output device is assigned to the other output device, the task may be seamlessly performed by transmitting data associated with the task to the assigned output device.

According to an embodiment, in the case where the first output device 201 is released from the ear of the user of the first output device 201, the processor 271 may assign a task being performed by the first output device 201 to the second output device 202. For example, if the first output device 201 is released from the ear of the user while the first output device 201 and the second output device 202 operate in a stereo mode, the processor 271 may control the second output device 202 such that the second output device 202 operates in a mono mode. The processor 271 may transmit the task being performed by the first output device 201 to the second output device 202 by using the communication circuit 261.

According to an embodiment, in the case where the second output device 202 is released from the ear of the user of the first output device 201, the processor 271 may receive data associated with the task being performed by the second output device 202 from the second output device 202 using the communication circuit 261.

The data associated with the task may be directly transmitted from the first output device 201 to the second output device 202 or from the second output device 202 to the first output device 201, and may be transmitted through another external device.

According to an embodiment, the processor 271 may assign a task being simultaneously performed by the first output device 201 and the second output device 202 to the first output device 201 or the second output device 202. For example, in the case where the task being redundantly performed is heart rate measurement, the result obtained by being measured by the first output device 201 may be the same as the result obtained by being measured by the second output device 202. In this case, unnecessary power consumption may be reduced by assigning a task to one output device of the first output device 201 or the second output device 202.

According to an embodiment, if the task is assigned to the first output device 201, the processor 271 may perform the task and may store the data associated with the task in at least one of the memory 241 and the memory 242 included in the second output device 202 based on importance of the task. For example, in the case where the importance of the task is relatively low, the processor 271 may store the data associated with the task in one of the memory 241 included in the first output device 201 or the memory 242 included in the second output device 202. As another example, in the case where the importance of the task is relatively high, the processor 271 may store the data associated with the task in the memory 241 included in the first output device 201 and the memory 242 included in the second output device 202. For example, a task of high importance may be a task that the user directly instructs to execute.

According to an embodiment, the processor 271 may assign a task for connecting with the external electronic device 20 to the first output device 201 or the second output device 202 based on information about the level of the battery 231 included in the first output device 201 and information about the level of the battery 232 included in the second output device 202. For example, the processor 271 may control the first output device 201 or the second output device 202 such that an output device, the battery level of which is relatively high, among the first output device 201 and the second output device 202 operates as a master.

According to an embodiment, as described above, even though a task is automatically assigned, the processor 271 may assign the task to the first output device 201 or the second output device 202 based on a user input. For example, the processor 271 may output a call voice, a notification, or the like in a mono mode. The processor 271 may control the first output device 201 or the second output device 202 such that only one of the first output device 201 or the second output device 202 is used. The processor 271 may control the microphone 221 of the first output device 201 and/or the microphone 222 of the second output device 202 such that the microphone 221 of the first output device 201 and/or the microphone 222 of the second output device 202 is activated.

According to an embodiment, operations described as being performed by the processor 271 of the first output device 201 may be performed by the processor 272 of the second output device 202 in the same manner. For example, the processor 271 of the first output device 201 may control the processor 272 of the second output device 202 such that the above-described operations are performed by the processor 272 of the second output device 202.

Figure 3:
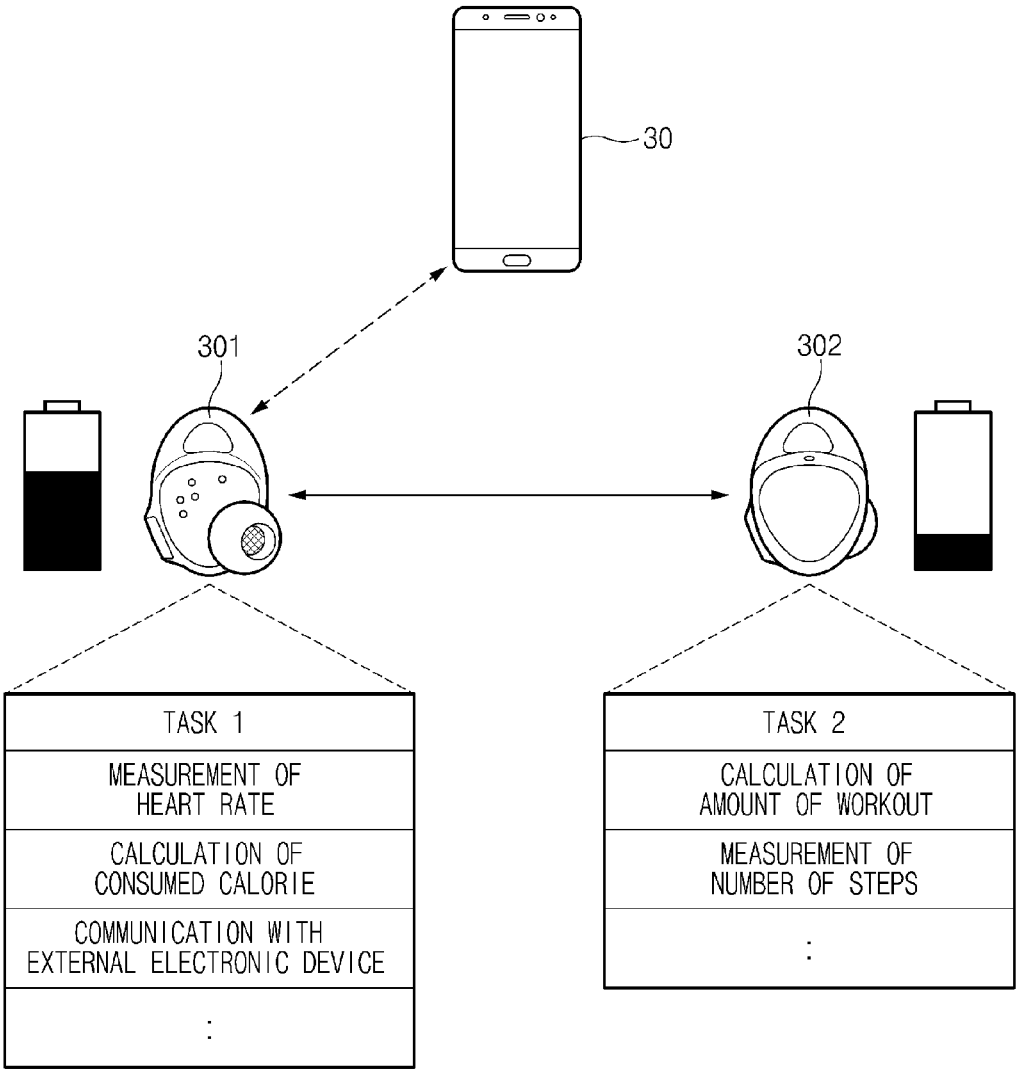
FIG. 3 is a diagram illustrating an example task assigned to an output device and the other output device coupled to the output device, according to an example embodiment.

FIG. 3 is a diagram illustrating an example task assigned to an output device and the other output device coupled to the output device, according to an example embodiment.

Referring to FIG. 3, a first output device 301 and a second output device 302 may be wirelessly associated with each other. The first output device 301 may be associated with an external electronic device 30. The first output device 301 may operate independently, not being associated with the external electronic device 30. For example, a battery level of the first output device 301 may be about 60% (as illustrated by the battery icon associated with the first output device 301), and a battery level of the second output device 302 may be about 20% (as illustrated by the battery icon associated with the second output device 302).

According to an embodiment, for example, the task assigned to the first output device 301 or the second output device 302 may include measurement of a heart rate, calculation (determination) of consumed calorie, communication with the external electronic device 30, calculation (determination) of an amount of workout, measurement of the number of steps, or the like, but is not limited thereto.

According to an embodiment, the first output device 301 may obtain information about the battery level of the first output device 301 and the battery level of the second output device 302. The first output device 301 may assign a task, in which the consumed current is relatively large, to the first output device 301, the battery level of which is relatively high, and may assign a task, in which the consumed current is relatively small, to the second output device 302, the battery level of which is relatively low. For example, the first output device 301 may perform a task, in which the consumed current is relatively great, such as the measurement of the heart rate, the calculation of the consumed calorie, the communication with the external electronic device 30, or the like. The first output device 301 may assign a task, in which the consumed current is relatively small, such as the calculation of the amount of workout, measurement of the number of steps, or the like to the second output device 302.

According to an embodiment, operations described as being performed by the first output device 301 may be performed by the second output device 302 in the same manner.

Figure 4:
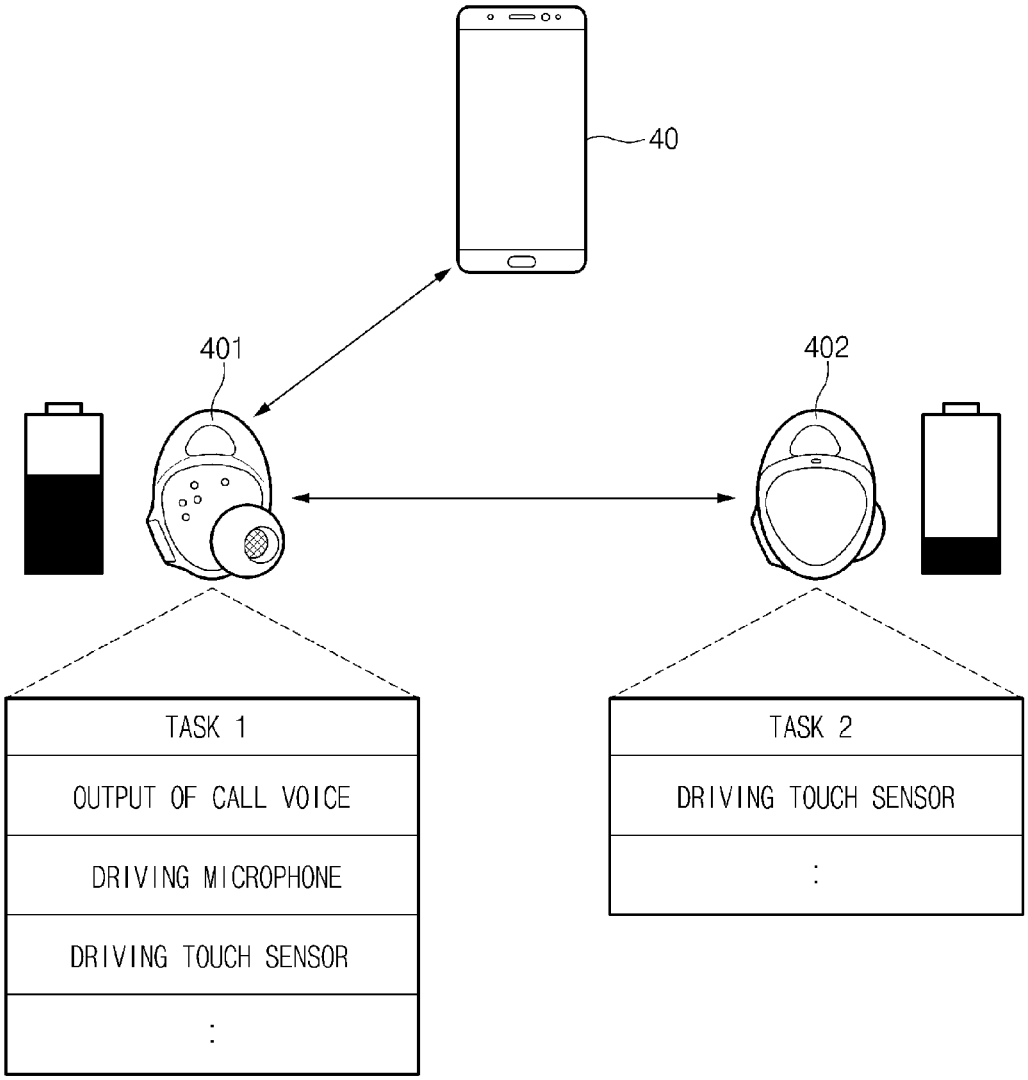
FIG. 4 is a diagram illustrating an example task assigned to an output device and the other output device coupled to the output device, according to an example embodiment.

FIG. 4 is a diagram illustrating an example task assigned to an output device and the other output device coupled to the output device, according to an example embodiment.

Referring to FIG. 4, a first output device 401 and a second output device 402 may be wirelessly associated with each other. The first output device 401 may be associated with an external electronic device 40. For example, a battery level of the first output device 401 may be about 60% (as illustrated by the battery icon associated with the first output device), and a battery level of the second output device 402 may be about 20% (as illustrated by the battery icon associated with the second output device 402).

According to an embodiment, the external electronic device 40 may make a call to another electronic device. The external electronic device 40 may transmit a voice transmitted during a call to the first output device 401. For example, the task assigned to the first output device 401 or the second output device 402 during a call may include the output of a call voice, microphone driving, touch sensor driving, or the like, but is not limited thereto.

According to an embodiment, the first output device 401 may obtain information about the battery level of the first output device 401 and the battery level of the second output device 402. The first output device 401 may assign a task to the first output device 401, having a relatively high battery level, and may not assign a task to the second output device 402, having a relatively low battery level. For example, the first output device 401 may perform a task such as a call voice output, microphone driving, touch sensor driving, or the like. However, since both the first output device 401 and the second output device 402 need to receive a touch input of a user, the first output device 401 may assign a task, such as the touch sensor driving or the like, to both the first output device 401 and the second output device 402.

According to an embodiment, operations described as being performed by the first output device 401 may be performed by the second output device 402 in the same manner.

Figure 5:
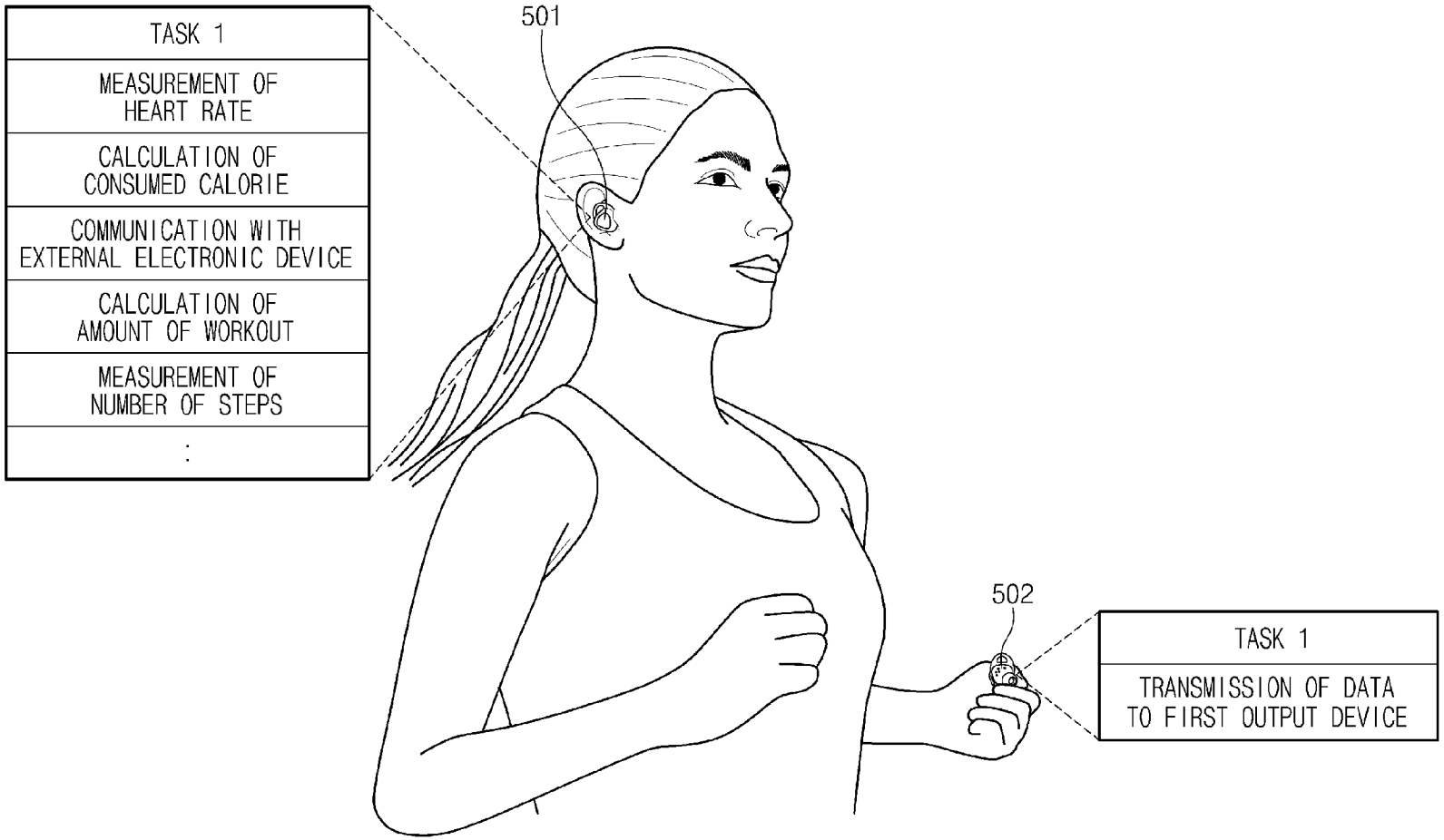
FIG. 5 is a diagram illustrating an example task assigned to an output device and the other output device coupled to the output device, according to an example embodiment.

FIG. 5 is a diagram illustrating an example task assigned to an output device and the other output device coupled to the output device, according to an example embodiment.

Referring to FIG. 5, a first output device 501 and a second output device 502 may be wirelessly associated with each other. The first output device 501 may be worn on/in an ear of a user, and the second output device 502 may not be worn on/in the ear of the user.

According to an embodiment, for example, the task assigned to the first output device 501 or the second output device 502 may include measurement of a heart rate, calculation of consumed calorie, communication with an external electronic device, calculation of an amount of workout, measurement of the number of steps, or the like, but is not limited thereto.

According to an embodiment, the first output device 501 may obtain information about a wearing state of the first output device 501 and information about a wearing state of the second output device 502. For example, the first output device 501 may recognize that the first output device 501 is worn on the ear of the user and the second output device 502 is released from the ear of the user. If the second output device 502 is released from the ear of the user, the first output device 501 may perform all tasks such as the measurement of the heart rate, the calculation of consumed calorie, the communication with the external electronic device, the calculation of the amount of workout, the measurement of the number of steps, or the like, but is not limited thereto. In the case where the second output device 502 is released from the ear of the user while a part of the above-described tasks are being performed by the second output device 502, the second output device 502 may transmit data associated with a task, which was being performed, to the first output device 501.

According to an embodiment, operations described as being performed by the first output device 501 may be performed by the second output device 502 in the same manner.

Figure 6:
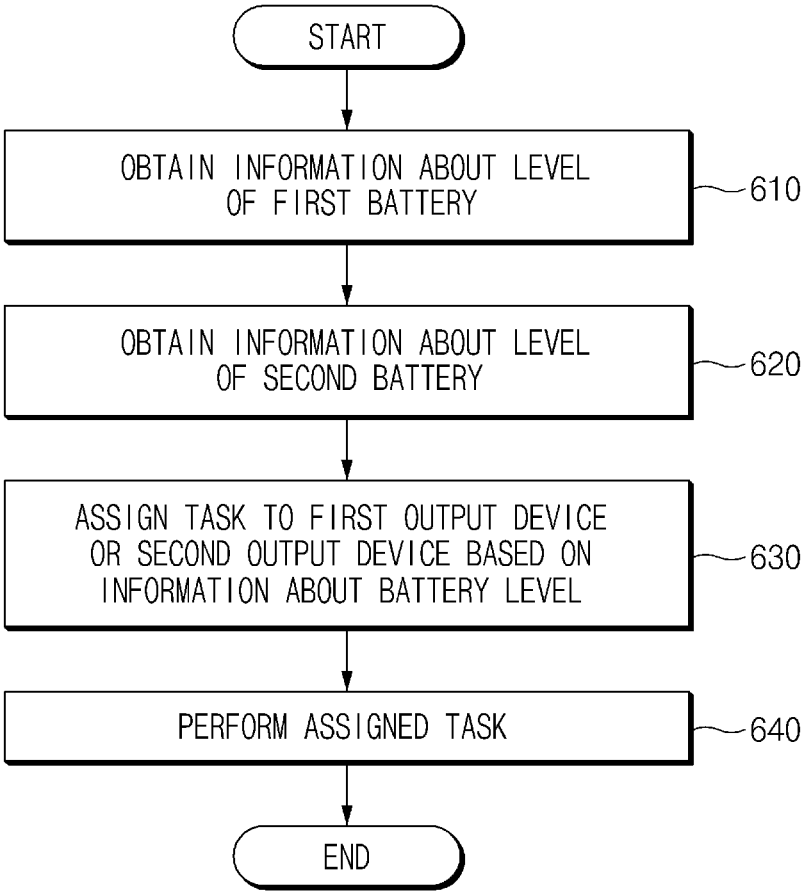
FIG. 6 is a flowchart illustrating an example task distributing method of an output device, according to an example embodiment.

FIG. 6 is a flowchart illustrating an example task distributing method of an output device, according to an example embodiment.

Hereinafter, it is assumed that the first output device 201 of FIG. 2 performs a process of FIG. 6. The process of FIG. 6 may be performed by the second output device 202 of FIG. 2. In addition, as described in FIG. 6, it will be understood that an operation described as being executed by a first output device may be controlled by the processor 271 of the first output device 201 (or the processor 272 of the second output device 202).

In operation 610, the first output device (e.g., the processor 271 of FIG. 2) may obtain information about a level of a first battery. For example, the first output device may obtain the information about the level of the first battery included in the first output device by using PIMC of the first output device.

In operation 620, the first output device (e.g., the processor 271 of FIG. 2) may obtain information about a level of a second battery. For example, the first output device may receive the information about the level of the second battery, which a second output device obtains, from the second output device through a communication circuit. For another example, the first output device may obtain the information about the level of the second battery included in the second output device based on data received from the second output device through the communication circuit.

In operation 630, the first output device (e.g., the processor 271 of FIG. 2) may assign a task to the first output device or the second output device based on information about a battery level. For example, the first output device may assign a task, the expected battery consumption of which is relatively great, or a task, the required throughput of which is relatively great, to an output device, the battery level of which is relatively high, of the first output device or the second output device. The first output device may assign a task, the expected battery consumption of which is relatively little, or a task, the required throughput of which is relatively small, to an output device, the battery level of which is relatively low, of the first output device or the second output device. The first output device may transmit information associated with at least one task assigned to the second output device to the second output device through the communication circuit.

In operation 640, the first output device (e.g., the processor 271 of FIG. 2) may perform a task assigned to the first output device. Furthermore, the second output device may perform a task assigned to the second output device.

Figure 7:
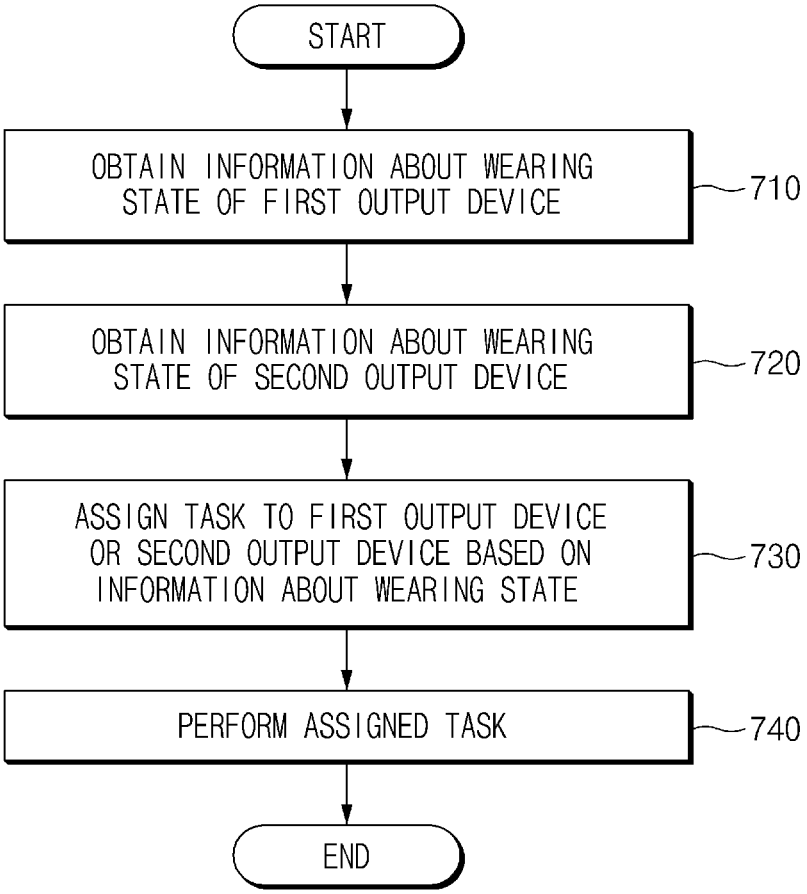
FIG. 7 is a flowchart illustrating an example task distributing method of an output device, according to an example embodiment.

FIG. 7 is a flowchart illustrating an example task distributing method of an output device, according to an example embodiment.

Hereinafter, it is assumed that the first output device 201 of FIG. 2 performs a process of FIG. 7. The process of FIG. 7 may be performed by the second output device 202 of FIG. 2. In addition, as described in FIG. 7, it will be understood that an operation described as being executed by a first output device may be controlled by the processor 271 of the first output device 201 (or the processor 272 of the second output device 202).

In operation 710, the first output device (e.g., the processor 271 of FIG. 2) may obtain information about a wearing state of the first output device. For example, in the case where a heart rate of a user is sensed by a HR sensor of the first output device or in the case where it is sensed that the first output device is close to a body (e.g., an ear) of the user, the first output device may determine that the first output device is worn on the ear of the user.

In operation 720, the first output device (e.g., the processor 271 of FIG. 2) may obtain information about a wearing state of a second output device. For example, the first output device may receive information indicating whether the second output device is worn on the ear of the user, from the second output device through a communication circuit. For another example, the first output device may receive data sensed by the HR sensor of the second output device from the second output device through the communication circuit, and may determine whether the second output device is worn on the ear of the user, based on the received data.

In operation 730, the first output device (e.g., the processor 271 of FIG. 2) may assign a task to the first output device or the second output device based on the information about the wearing state. For example, the first output device may assign a task to an output device, which is worn on the user, of the first output device or the second output device. For another example, the first output device may assign a task being performed by an output device, which is released from the ear of the user, of the first output device or the second output device to another output device.

In operation 740, the first output device (e.g., the processor 271 of FIG. 2) may perform a task assigned to the first output device. Furthermore, the second output device may perform a task assigned to the second output device.

Figure 8:
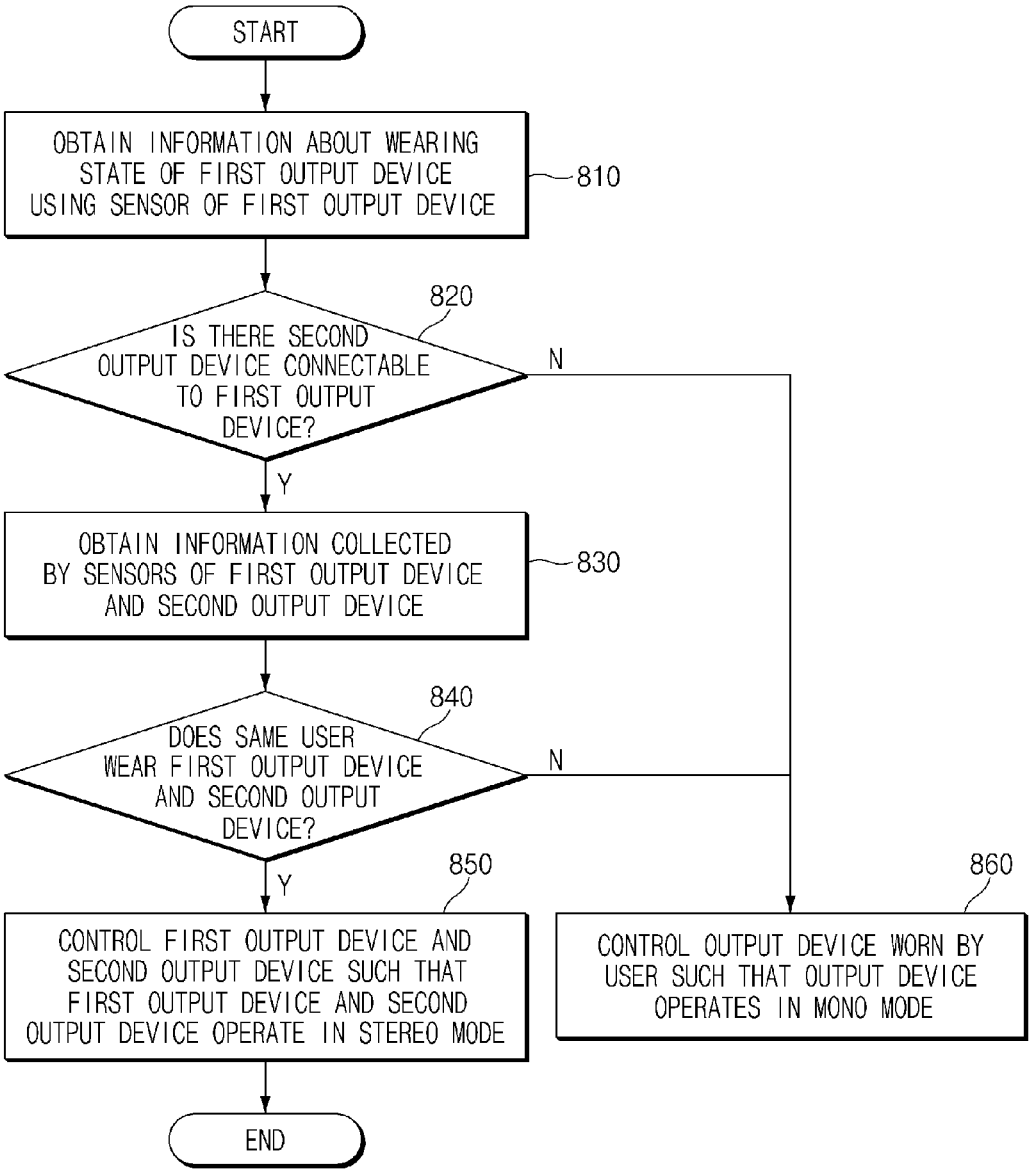
FIG. 8 is a flowchart illustrating an example task distributing method of an output device, according to an example embodiment.

FIG. 8 is a flowchart illustrating an example task distributing method of an output device, according to an example embodiment.

Hereinafter, it is assumed that the first output device 201 of FIG. 2 performs a process of FIG. 8. The process of FIG. 8 may be performed by the second output device 202 of FIG. 2. In addition, as described in FIG. 8, it will be understood that an operation described as being executed by a first output device may be controlled by the processor 271 of the first output device 201 (or the processor 272 of the second output device 202).

In operation 810, the first output device (e.g., the processor 271 of FIG. 2) may obtain information about a wearing state of the first output device using a sensor of the first output device.

In operation 820, the first output device (e.g., the processor 271 of FIG. 2) may determine whether there is a second output device connectable to the first output device. For example, the first output device may search for devices placed in the vicinity of the first output device by using a communication circuit. If the second output device is found within a distance communicable with the first output device, the first output device may be associated with the second output device.

In the case where the connectable second output device is present, in operation 830, the first output device (e.g., the processor 271 of FIG. 2) may obtain information collected by sensors of the first output device and the second output device. For example, the first output device may collect information such as a heart rate, acceleration, and/or angular velocity using the sensor of the first output device. The first output device may receive information, such as the heart rate, the acceleration, and/or the angular velocity, collected by the second output device from the second output device.

In operation 840, the first output device (e.g., the processor 271 of FIG. 2) may determine whether the same user wears the first output device and the second output device. According to an embodiment, whether the first output device and the second output device are inserted into ears of the same user may be determined based on data sensed by the sensor of the first output device and a sensor included in the second output device. For example, and without limitation, if a heart rate, heart rate waveform, electrocardiogram (ECG), acceleration, or angular velocity sensed by the first output device corresponds to a heart rate, heart rate waveform, ECG, acceleration, or angular velocity sensed by the second output device, the first output device may determine whether the first output device and the second output device are inserted into the ears of the same user.

In the case where the first output device and the second output device are worn on the same user, in operation 850, the first output device (e.g., the processor 271 of FIG. 2) may control the first output device and the second output device such that the first output device and the second output device operate in a stereo mode. For example, the first output device and the second output device may output sound of different channels.

In the case where there is no second output device connectable to the first output device, or in the case where the first output device and the second output device are not worn on the same user, in operation 860, the first output device (e.g., the processor 271 of FIG. 2) may control an output device worn by the user such that the output device operates in a mono mode. For example, both the first output device and the second output device may output sound of the same channel. For another example, only one output device of the first output device and the second output device may output sound.

According to an embodiment, in the case where one of the first output device and the second output device is unavailable, an available output device of the first output device and the second output device may operate in the mono mode. For example, in the case where one of the first output device and the second output device is released from the ear of the user or is discharged, an output device, which is worn on the ear of the user or the battery level of which is maintained, of the first output device and the second output device may operate in the mono mode.

The term "module" used herein may refer, for example, and without limitation, to a unit, which is implemented with hardware, software, firmware, or any combination thereof, and may be interchangeably used with the terms "logic", "logical block", "component", "circuit", or the like. The "module" may be a minimum unit of an integrated component or a part thereof or may be a minimum unit for performing one or more functions or a part thereof. The "module" may be implemented mechanically or electronically and may include, for example, and without limitation, a dedicated processor, a CPU, an application-specific IC (ASIC) chip, a field-programmable gate array (FPGA), and a programmable-logic device for performing some operations, which are known or will be developed. According to various embodiments, at least a part of an apparatus (e.g., modules or functions thereof) or a method (e.g., operations) may be, for example, implemented by instructions stored in a computer-readable storage media (e.g., the memory 130) in the form of a program module. The instruction, when executed by a processor (e.g., a processor 120), may cause the processor to perform a function corresponding to the instruction. The computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), an embedded memory, or the like. The instruction may include codes created by a compiler or codes that are capable of being executed by a computer by using an interpreter. According to various embodiments, a module or a program module may include at least one of the above elements, or a part of the above elements may be omitted, or other elements may be further included. According to various embodiments, operations executed by modules, program modules, or other elements may be executed by a successive method, a parallel method, a repeated method, or a heuristic method, or at least one part of operations may be executed in different sequences or omitted. Alternatively, other operations may be added.

While the present disclosure has been illustrated and described with reference to various example embodiments thereof, it will be understood by those skilled in the art that various changes in form and details may be made therein without departing from the spirit and scope of the present disclosure as defined by the appended claims and their equivalents.

What is claimed is:

1. An output device configured to output an audio signal comprising:

a battery;

a sensing module including a plurality of sensors;

a communication circuit configured to communicate with at least one of an external electronic device and another output device for outputting an audio signal coupled to the output device; and a processor electrically connected with the battery, the sensing module, and the communication circuit, wherein the processor is configured to:

obtain information about a level of the battery;

obtain information about a level of another battery included in the another output device using the communication circuit; and determine which output device to assign a task associated with one of the plurality of sensors, from among the output device configured to output an audio signal and the another output device for outputting an audio signal coupled thereto, based on each of: (i) the information about the level of the battery of the output device, (ii) the information about the level of the another battery of the another output device, and (iii) whether one of the sensors has been determined to be in a non-usable state.

2. The output device of claim 1, wherein the processor is further configured to:

assign the task based on information about current consumption of the task.

3. The output device of claim 1, wherein the sensing module includes at least one of: a heart rate (HR) sensor, an acceleration sensor, a gyro sensor, an infrared (IR) sensor and a proximity sensor.

4. The output device of claim 1, wherein the processor is further configured to:

obtain information about a wearing state of the output device based on data sensed by the sensing module;

obtain information about a wearing state of the another output device from the another output device using the communication circuit; and assign the task to the output device or the another output device based on the information about the wearing state of the output device and the information about the wearing state of the another output device.

5. The output device of claim 1, wherein the processor is further configured to:

perform the task if the task is assigned to the output device; and transmit data associated with the task to the another output device using the communication circuit.

6. The output device of claim 1, wherein the processor is further configured to:

transmit data associated with a task being performed by the output device to the another output device using the communication circuit if the task being performed by the output device is assigned to the another output device.

7. The output device of claim 1, wherein the processor is further configured to:

interrupt a task being performed by the output device if the task being performed by the output device is assigned to the another output device.

8. The output device of claim 1, wherein the processor is further configured to:

assign a task being simultaneously performed by the output device and the another output device to the output device or the another output device.

9. The output device of claim 1, wherein the output device further includes a memory electrically connected with the processor, wherein the processor is configured to:

perform the task if the task is assigned to the output device; and store data associated with the task in at least one of the memory or another memory included in the another output device based on an importance of the task.

10. The output device of claim 1, wherein the processor is further configured to:

assign a task for connecting the external electronic device to the output device or the another output device based on the information about the level of the battery and the information about the level of the another battery.

11. An output device configured to output an audio signal, comprising:

a battery;

a sensing module including a plurality of sensors;

a communication circuit configured to communicate with at least one of an external electronic device and another output device for outputting an audio signal coupled to the output device; and a processor electrically connected with the battery, the sensing module, and the communication circuit, wherein the processor is configured to:

obtain information about a wearing state of the output device indicative of whether the output device is being worn by a user based on data sensed by the sensing module;

obtain information about a wearing state of the another output device indicative of whether the another output device is being worn by the user from the another output device using the communication circuit; and determine which output device to assign a task, from among the output device configured to output an audio signal and the another output device for outputting an audio signal coupled thereto, based on the information about the wearing state of the output device and the information about the wearing state of the another output device, and based on whether the output device and the another output device are being worn by the user.

12. The output device of claim 11, wherein the processor is further configured to:

determine whether the output device is inserted into an ear of a user of the output device, based on the data sensed by the sensing module.

13. The output device of claim 12, wherein the processor is further configured to:

assign the task to a device inserted into the ear of the user of the output device and the another output device.

14. The output device of claim 11, wherein the processor is further configured to:

transmit data associated with a task being performed by the output device to the another output device using the communication circuit if the output device is released from the ear of the user of the output device.

15. The output device of claim 11, wherein the processor is further configured to:

receive data associated with a task being performed by the another output device from the another output device using the communication circuit if the another output device is released from the ear of the user of the output device.

16. The output device of claim 11, wherein the processor is further configured to:

determine whether the output device and the another output device are inserted into ears of the same user, based on the data sensed by the sensing module and data sensed by another sensing module included in the another output device.

17. A method of controlling an output device that outputs an audio signal, the method comprising:

obtaining information about a level of a battery included in the output device;

obtaining information about a level of another battery included in another output device for outputting an audio signal coupled to the output device; and assigning a task associated with one of a plurality of sensors, from among the output device that outputs an audio signal and the another output device for outputting an audio signal coupled thereto, based on each of: (i) the information about the level of the battery, (ii) the information about the level of the another battery, and (iii) whether one of the sensors has been determined to be in a non-usable state.

18. The method of claim 17, wherein the assigning includes:

assigning the task based on information about current consumption of the task.

19. The method of claim 17, further comprising:

obtaining information about a wearing state of the output device based on data sensed by at least one of the plurality of sensors included in the output device; and obtaining information about a wearing state of the another output device from the another output device, wherein the assigning includes:

assigning the task based on the information about the wearing state of the output device and the information about the wearing state of the another output device.

* * * * *